US008912474B2

(12) United States Patent
Parsons

(10) Patent No.: US 8,912,474 B2
(45) Date of Patent: Dec. 16, 2014

(54) FOOD TRAY

(76) Inventor: Steven Parsons, Oyama (CA)

( * ) Notice: Subject to any disclaimer, the term of this patent is extended or adjusted under 35 U.S.C. 154(b) by 548 days.

(21) Appl. No.: 13/234,069

(22) Filed: Sep. 15, 2011

(65) Prior Publication Data

US 2012/0061386 A1 Mar. 15, 2012

Related U.S. Application Data

(60) Provisional application No. 61/393,979, filed on Oct. 18, 2010.

(30) Foreign Application Priority Data

Sep. 15, 2010 (CA) ..... 2714877

(51) Int. Cl.

| | |
|---|---|
| ***H05B 6/80*** | (2006.01) |
| ***B65D 81/34*** | (2006.01) |
| ***H05B 6/64*** | (2006.01) |
| ***B65D 81/32*** | (2006.01) |

(52) U.S. Cl.

CPC ..... *H05B 6/6408* (2013.01); *B65D 81/3446* (2013.01); *B65D 81/3216* (2013.01)

USPC ..... 219/734

(58) Field of Classification Search

USPC ..... 220/23.87, 676, 23.83, 573.4–573.5; 426/107; 219/676, 725, 735

See application file for complete search history.

(56) References Cited

U.S. PATENT DOCUMENTS

| | | | | | |
|---|---|---|---|---|---|
| 1,349,567 | A | * | 8/1920 | Gammel | 220/324 |
| 4,449,633 | A | | 5/1984 | Johnson | |
| 4,486,640 | A | * | 12/1984 | Bowen et al. | 219/729 |
| 4,924,048 | A | | 5/1990 | Bunce | |
| 5,012,929 | A | | 5/1991 | Roosa | |
| 5,101,084 | A | * | 3/1992 | Atwell et al. | 219/728 |
| 5,242,106 | A | | 9/1993 | Gulliver | |
| 5,267,686 | A | | 12/1993 | Gulliver | |
| 5,423,449 | A | | 6/1995 | Gordon | |
| 5,657,873 | A | | 8/1997 | Hustad | |
| 6,085,930 | A | * | 7/2000 | Curtis | 220/371 |
| 6,187,354 | B1 | | 2/2001 | Hopkins | |
| 6,559,431 | B2 | | 5/2003 | Hopkins | |

(Continued)

FOREIGN PATENT DOCUMENTS

| | | |
|---|---|---|
| CA | 2 527 770 A1 | 3/2006 |
| CA | 2 630 367 A1 | 5/2007 |

(Continued)

OTHER PUBLICATIONS

Photographs of a food tray available from Inter Frost GmbH at a trade show in Germany, Oct. 2005, 3 pages.

*Primary Examiner* — Dana Ross
*Assistant Examiner* — Renee L Miller
(74) *Attorney, Agent, or Firm* — Christensen O'Connor Johnson Kindness PLLC

(57) ABSTRACT

A food tray is provided with an upper tray and a lower tray containing food products, in which the upper tray rests snugly in the lower tray and a lid seals the upper tray. Vent holes in the lower tray allow steam released from the food product in the lower tray to escape out of the lower tray. Each of the upper tray and lower tray may have flanges to allow the upper tray to be lifted out of the lower tray without difficulty.

11 Claims, 2 Drawing Sheets

(56) References Cited

U.S. PATENT DOCUMENTS

| | | | | |
|---|---|---|---|---|
| 6,732,662 | B2 | 5/2004 | Welch | |
| 6,920,830 | B1 | 7/2005 | Asbach | |
| 2002/0096056 | A1* | 7/2002 | Hopkins | 99/422 |
| 2003/0049354 | A1 | 3/2003 | Murray | |
| 2004/0058038 | A1* | 3/2004 | Lee | 426/107 |
| 2005/0051549 | A1* | 3/2005 | Nelson | 220/23.83 |
| 2006/0068063 | A1 | 3/2006 | Zerfas | |
| 2007/0090103 | A1 | 4/2007 | France | |
| 2007/0116806 | A1 | 5/2007 | Parsons | |
| 2007/0116807 | A1 | 5/2007 | Parsons | |
| 2007/0172554 | A1* | 7/2007 | Blythe et al. | 426/106 |
| 2007/0181008 | A1 | 8/2007 | Pawlick | |
| 2008/0063759 | A1 | 3/2008 | Raymond | |
| 2009/0179029 | A1* | 7/2009 | Dilonardo et al. | 219/733 |
| 2009/0297673 | A1* | 12/2009 | Sebban et al. | 426/107 |

FOREIGN PATENT DOCUMENTS

| | | | |
|---|---|---|---|
| CA | 2 612 651 | A1 | 5/2009 |
| CA | 2 644 928 | A1 | 5/2009 |
| EP | 0 449 643 | A1 | 10/1991 |
| WO | 99/59897 | A3 | 11/1999 |
| WO | 2007/056866 | A1 | 5/2007 |
| WO | 2007/141140 | A2 | 12/2007 |
| WO | 2010/009073 | A2 | 1/2010 |

* cited by examiner

FOOD TRAY

TECHNICAL FIELD

Food trays.

BACKGROUND

Microwavable food trays are well known including designs by the inventor of the invention disclosed in this patent document. In one prior design by the inventor, disclosed in Publication No. WO 2007/056866, published May 24, 2007, an upper tray was loosely nested in a lower tray, with a gap between the trays to allow steam to vent from the lower tray during cooking. With such a design, however, steam escaping from the lower tray might burn a user's fingers when they picked up the upper tray. In another design, sold in Europe, and also mentioned in the Publication No. WO 2007/056866, snugly nested rectangular upper and lower trays provided separate compartments for different foods. This design, made of paperboard, was defective in that steam could build up between the snugly nested trays.

SUMMARY

Therefore, in an embodiment there is provided a food tray, in which food products may be heated by a microwave, comprising an upper tray containing a first food product, a lower tray containing a second food product, and a lid sealing the upper tray. The upper tray rests snugly in the lower tray to prevent flow of steam between the upper tray and the lower tray beyond a close fit line on the lower tray, and the lower tray has at least a vent hole below the close fit line for escape of steam when the second food product is subject to microwave energy.

In an embodiment, the food tray is made from cardboard or paperboard, and in another embodiment is rectangular.

In an embodiment, each of the upper tray and lower tray has a flange, and the flange of the upper tray extends farther outward than the flange of the lower tray, allowing the upper tray to be more easily removed from the upper tray. Other embodiments can be found in the claims.

BRIEF DESCRIPTION OF THE FIGURES

There will now be given a brief description of a food tray, by reference to the drawings, by way of illustration only, and in which.

DETAILED DESCRIPTION

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

Figure 1:
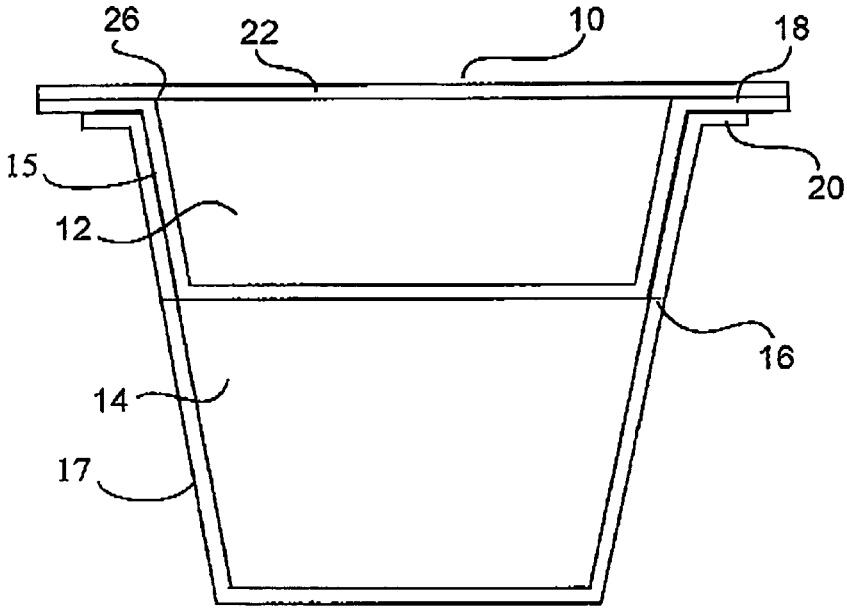
FIG. 1 is a cross-section of an embodiment of a food tray.

Referring to FIG. 1, an embodiment of a food tray 10 is shown to include an upper tray 12 resting snugly in a lower tray 14, to prevent flow of steam between the upper tray 12 and the lower tray 14 beyond a close fit line 16 on the lower tray 14. In this embodiment, the close fit line 16 is where contact between the upper tray 12 and lower tray 14 ceases. In this embodiment, both the upper tray 12 and lower tray 14 may be rectangular in a horizontal cross-section through the trays and taper downward with the same taper, although FIG. 1 also applies to a tray that is circular or elliptical (oval) in plan. The direction horizontal is defined by the normal position of the trays in use, that is, with the top upward. Same taper means that the tapers of the trays match each other, that is, have the side walls have the same slope in relation to the horizontal.

The close fit line 16, as shown in FIG. 1, may correspond to the depth that the upper tray 12 reaches when seated in lower tray 14. If the downward taper of the upper tray 12 and lower tray 14 is the same, then the close fit line 16 will be at the depth the bottom of the upper tray 12 reaches in the lower tray 14. The close fit of the upper tray 12 and lower tray 14 in this case extends the full height of the upper tray 12, but this is not necessary and the close fit line could be above the bottom of the upper tray 12. Snugly nested in this embodiment means that there is contact between the upper tray 12 and lower tray 14 all around the perimeter of the upper tray 14. Thus, steam pressure, absent any other outlet for steam as for example the vent holes 24 described below in relation to FIG. 2, would build up within the lower tray 14 when moist food in the lower tray 14 is subject to microwave heating energy. An example of a close fit line above the bottom of the upper tray 12 is where the upper tray 12 is stepped inward part way down the wall of the upper tray, with only the upper part of the upper tray 12, above the step, being snugly fit with the lower tray 14.

In the embodiment shown, each tray of food tray 10 is formed at least of side walls defining an encircling wall 15 and 17, a top and a bottom. Each side wall and the bottom in this embodiment is rectangular. In other embodiments, the food tray 10 may be round or elliptical or have other shapes such as polygonal shapes.

The upper tray 12 has an encircling wall 15 with a top or rim and a flange 18 extending outward from the top of the encircling wall 15. The lower tray 14 has an encircling wall 17 with a top, or rim and a flange 20 extending outward from the top of the encircling wall. The flange 18 of the upper tray 12 extends beyond the flange 20 of the lower tray 14 to facilitate the removal of the upper tray 12 from the lower tray 14. The flange 18 of the upper tray 12 in an embodiment may extend approximately 2-10 mm outward from the rim 26 of the upper tray 12 in a food tray 10 of approximate lateral dimensions 6-8 cm by 8-10 cm. The flange 18 of the upper tray 12 may be sealed to the flange 20 of the lower tray 14. A lid 22 is heat sealed to the flange 18 of the upper tray 12, where the lid and the flange 18 of the upper tray 12 are coextensive. Alternatively, the lid 22 is glued to the flange 18 of the upper tray 12, or in another embodiment, instead of a lid or in addition to a lid the entire food tray 10 is sealed with shrink wrap.

Figure 2:
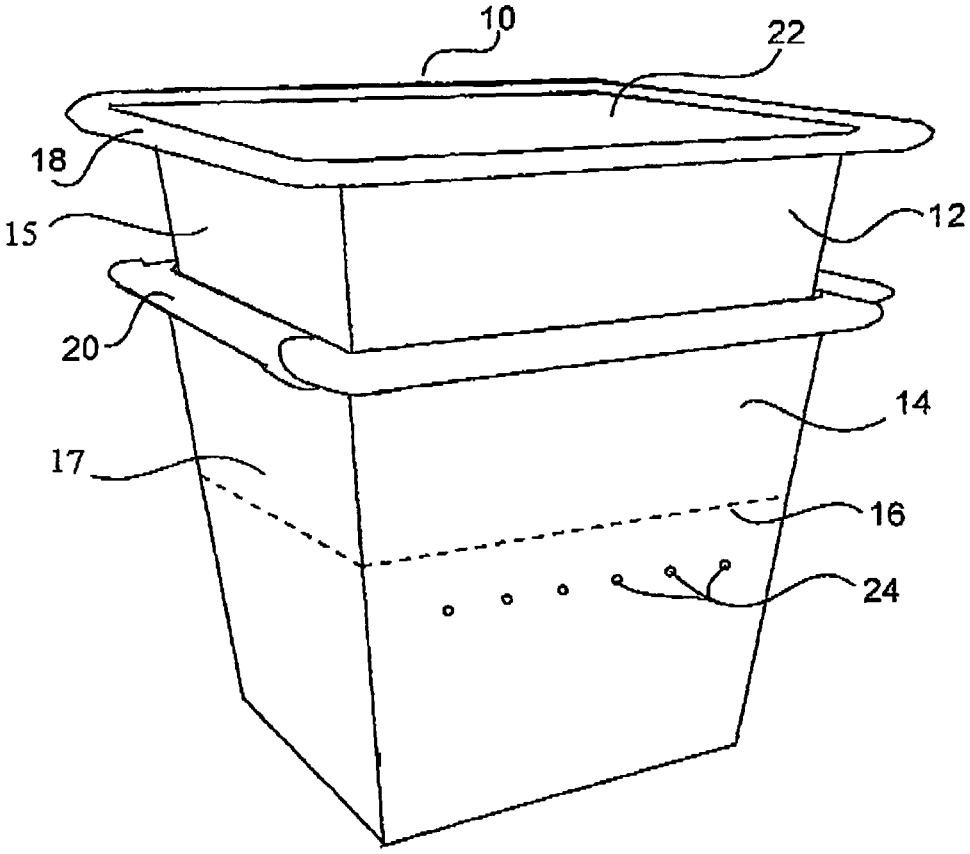
FIG. 2 is a perspective view of an embodiment of a food tray.

Referring to FIG. 2, an embodiment of a food tray 10 is shown to include upper tray 12 lifted out of lower tray 14. When the upper tray 12 is lowered into the lower tray 14 to rest snugly in the lower tray 14, the bottom surface of the lower tray reaches close fit line 16, and steam is prevented from flowing between the upper tray 12 and lower tray 14. Vent holes 24 in the lower tray 14 are below the close fit line 16 to allow for escape of steam when the second food product is subject to microwave energy. One or more vent holes 24 may be used. The vent holes 24 may have any suitable shape and should be sufficiently large to prevent steam build up in the lower tray 14 when moist food in the lower tray 14 is subject to microwave heating energy. Preferably, the vent holes 24 are located fairly close to the close fit line 16 but above a level of food in the lower tray 14. To allow food to fill the lower tray to a maximum amount, close to the base of the lower tray, the side walls of the upper tray may be stepped inward near the base of the lower tray to allow the vent holes 24 to be above the base of the lower tray, but still below a close fit line. The vent hole or holes 24 may be distributed in any convenient fashion around the encircling wall 17 of the food tray. The food tray 10 may be made of any suitable material such as paperboard, which allows labels to be printed directly on the food tray 10, or plastic, such as injected plastic, which can be covered by a sleeve, with the label printed on the sleeve or directly on the plastic.

The embodiments of the invention in which an exclusive property or privilege is claimed are defined as follows:

1. A food tray, comprising:

an upper tray resting snugly in a lower tray to prevent flow of steam between the upper tray and the lower tray beyond a close fit line on the lower tray;

the upper tray having an encircling wall, the encircling wall of the upper tray having a top;

the lower tray having an encircling wall, the encircling wall of the lower tray having a top;

a first food product in the upper tray;

a second food product in the lower tray, the second food product providing steam when subject to microwave energy;

a lid sealing the upper tray; and the lower tray having at least one vent hole below the close fit line for escape of steam when the second food product is subject to microwave energy.

2. The food tray of claim 1 further comprising:

an upper tray flange extending outward from the top of the encircling wall of the upper tray;

a lower tray flange extending outward from the top of the encircling wall of the lower tray; and the upper tray flange extending outward beyond the lower tray flange to facilitate the removal of the upper tray from the lower tray.

3. A food tray, comprising:

an upper tray resting snugly in a lower tray to prevent flow of gas between the upper tray and the lower tray beyond a close fit line on the lower tray;

the upper tray having an encircling wall, the encircling wall of the upper tray having a top and an upper tray flange extending outward from the top of the encircling wall of the upper tray;

the lower tray having an encircling wall, the encircling wall of the lower tray having a top and a lower tray flange extending outward from the top of the encircling wall of the lower tray;

the upper tray flange extending outward beyond the lower tray flange to facilitate the removal of the upper tray from the lower tray;

a first food product in the upper tray;

a second food product in the lower tray, the second food product providing steam when subject to microwave energy; and a lid sealing at least the upper tray.

4. The food tray of claim 1 in which the upper tray and lower tray are each made of paperboard.

5. The food tray of claim 1 in which the encircling wall of the upper tray and the encircling wall of the lower tray are each formed of rectangular side walls.

6. The food tray of claim 1 in which the upper tray tapers downward with a first taper and the lower tray tapers downward with a second taper, and the first taper matches the second taper.

7. The food tray of claim 1 in which each of the upper tray and the lower tray are rectangular in horizontal cross-section.

8. The food tray of claim 3 in which the upper tray and lower tray are each made of paperboard.

9. The food tray of claim 3 in which the encircling wall of the upper tray and the encircling wall of the lower tray are each formed of rectangular side walls.

10. The food tray of claim 3 in which the upper tray tapers downward with a first taper and the lower tray tapers downward with a second taper, and the first taper matches the second taper.

11. The food tray of claim 3 in which each of the upper tray and the lower tray are rectangular in horizontal cross-section.

* * * * *